US011819727B2

(12) United States Patent
Robinson

(10) Patent No.: US 11,819,727 B2
(45) Date of Patent: Nov. 21, 2023

(54) RESISTANCE-BASED EXERCISE APPARATUS

(71) Applicant: 1195143 B.C. LTD., Langley (CA)

(72) Inventor: Brian K. Robinson, Cowansville (CA)

(73) Assignee: 1195143 B.C. LTD., White Rock (CA)

( * ) Notice: Subject to any disclaimer, the term of this patent is extended or adjusted under 35 U.S.C. 154(b) by 107 days.

(21) Appl. No.: 17/217,243

(22) Filed: Mar. 30, 2021

(65) Prior Publication Data

US 2021/0283455 A1 Sep. 16, 2021

Related U.S. Application Data

(63) Continuation of application No. 16/082,316, filed as application No. PCT/CA2017/050300 on Mar. 6, 2017, now Pat. No. 11,123,596.
(Continued)

(51) Int. Cl.
*A63B 21/16* (2006.01)
*A63B 21/00* (2006.01)
(Continued)

(52) U.S. Cl.
CPC .... *A63B 21/1645* (2013.01); *A63B 21/00065* (2013.01); *A63B 21/0428* (2013.01);
(Continued)

(58) Field of Classification Search
CPC ..... A63B 21/00; A63B 21/00185; A63B 21/00189; A63B 21/0204; A63B 21/0442;
(Continued)

(56) References Cited

U.S. PATENT DOCUMENTS 254,108 A 2/1882 Bryon
1,538,844 A 5/1925 Titus
(Continued)

FOREIGN PATENT DOCUMENTS

CA 1284666 C 6/1991
CN 2805828 Y 8/2006
(Continued)

OTHER PUBLICATIONS

Partial English translation of Office Action dated Jul. 3, 2020 in the corresponding Chinese patent application No. 2017800641695.
(Continued)

*Primary Examiner* — Sundhara M Ganesan
*Assistant Examiner* — Zachary T Moore
(74) *Attorney, Agent, or Firm* — Norton Rose Fulbright Canada LLP

(57) ABSTRACT

An exercise apparatus includes an elongated support element extending between first and second ends. The support element has a mounting member located at each of the first and second ends to engage with a door or wall surface and mount the support element thereto. A resistance-generating assembly includes a stationary member attached to the support element. A displaceable member is mountable to the support element and displaceable therealong relative to the stationary member. A resilient member is removably mountable between the stationary and displaceable members. The resilient member generates resistance upon being elastically deformed by displacement of the displaceable member relative to the stationary member. A pulley is mounted to the displaceable member and displaceable therewith, and another pulley is mounted to the support element. A hand-operable cable engages the pulleys to effect displacement of the displaceable member relative to the stationary member. A method is also disclosed.

16 Claims, 7 Drawing Sheets

Related U.S. Application Data

(60) Provisional application No. 62/304,528, filed on Mar. 7, 2016.

(51) Int. Cl.
*A63B 23/035* (2006.01)
*A63B 23/12* (2006.01)
*A63B 21/04* (2006.01)
*A63B 21/055* (2006.01)

(52) U.S. Cl.
CPC ..... *A63B 21/0552* (2013.01); *A63B 21/0555* (2013.01); *A63B 21/154* (2013.01); *A63B 21/169* (2015.10); *A63B 21/4035* (2015.10); *A63B 21/4047* (2015.10); *A63B 23/03525* (2013.01); *A63B 23/1209* (2013.01); *A63B 2210/50* (2013.01); *A63B 2225/093* (2013.01)

(58) Field of Classification Search
CPC ..... A63B 21/055; A63B 21/0552; A63B 21/0555; A63B 21/0557; A63B 21/15; A63B 21/151; A63B 21/154; A63B 21/156; A63B 21/16; A63B 21/1618; A63B 21/1627; A63B 21/1636; A63B 21/1645; A63B 21/1654; A63B 21/1663; A63B 21/169; A63B 21/02; A63B 21/021; A63B 21/022; A63B 21/023; A63B 21/04; A63B 21/0407; A63B 21/0414; A63B 21/06; A63B 21/062; A63B 21/0624; A63B 21/0626; A63B 21/0622; A63B 21/0628; A63B 2210/00; A63B 2210/50; A63B 2210/52
See application file for complete search history.

(56) References Cited

U.S. PATENT DOCUMENTS 1,620,910 A 3/1927 Minnich
1,633,124 A 6/1927 Noe
1,749,544 A 3/1930 Pagano
2,930,614 A 3/1960 McIntosh
2,977,120 A * 3/1961 Morris ..... A63B 21/156 482/103
3,427,023 A 2/1969 Silberman
3,861,675 A * 1/1975 Hopper ..... A63B 69/12 482/55
3,863,521 A 2/1975 Gatsos
3,958,803 A 5/1976 Geisselbrecht
4,072,309 A 2/1978 Wilson
4,402,504 A * 9/1983 Christian ..... A63B 21/156 482/129
4,492,375 A 1/1985 Connelly
4,582,320 A 4/1986 Shaw
4,621,805 A 11/1986 Chen
4,666,151 A * 5/1987 Chillier ..... A63B 21/04 482/99
4,685,670 A * 8/1987 Zinkin ..... A63B 21/169 482/904
4,830,365 A * 5/1989 March ..... A63B 21/1663 482/129
5,029,850 A 7/1991 Van Straaten
5,050,869 A 9/1991 Frate
5,135,216 A 8/1992 Bingham et al.
5,144,859 A 9/1992 Malone
5,242,353 A 9/1993 Cole et al.
5,334,122 A 8/1994 Cole et al.
5,387,171 A 2/1995 Casey et al.
5,468,205 A 11/1995 McFall et al.
5,603,681 A 2/1997 Olschansky et al.
5,616,111 A 4/1997 Randolph
5,722,922 A 3/1998 Watterson et al.
5,820,529 A * 10/1998 Weintraub ..... A63B 21/0552 482/904
5,842,939 A * 12/1998 Pui ..... A63B 63/004 273/400
5,885,196 A 3/1999 Gvoich
6,015,371 A * 1/2000 Davitt ..... A63B 21/0552 482/129
6,042,523 A 3/2000 Graham
6,142,919 A * 11/2000 Jorgensen ..... A63B 21/154 482/904
6,319,179 B1 * 11/2001 Hinds ..... A63B 21/0552 482/121
6,494,817 B2 * 12/2002 Lake ..... A63B 21/154 482/904
6,669,609 B2 * 12/2003 Gerschefske ..... A63B 21/4007 482/130
6,676,576 B1 1/2004 Wu
7,163,500 B2 1/2007 Endelman et al.
7,172,538 B2 * 2/2007 Keiser ..... A63B 23/03533 482/907
7,572,212 B2 * 8/2009 Cassidy ..... A63B 23/12 482/904
7,931,570 B2 4/2011 Hoffman
8,317,667 B1 11/2012 Thomas
8,485,950 B2 7/2013 Adams
8,485,951 B1 * 7/2013 Adams ..... A63B 21/00072 482/904
8,562,492 B2 10/2013 Gerschefske et al.
9,005,086 B1 4/2015 O'Neil
9,028,381 B2 5/2015 Mestemaker
9,339,682 B2 * 5/2016 Braier ..... A63B 21/1618
9,643,042 B2 5/2017 Madden
2001/0046928 A1 * 11/2001 Nette ..... A63B 21/0552 482/55
2003/0023270 A1 1/2003 Danz et al.
2003/0069112 A1 * 4/2003 Williams ..... A63B 21/156 482/99
2003/0195095 A1 10/2003 Endelman
2003/0232707 A1 12/2003 Dalebout
2004/0166999 A1 8/2004 Dodge
2005/0113223 A1 5/2005 Dovner
2009/0247376 A1 10/2009 Merrithew
2010/0304939 A1 12/2010 Svenberg
2010/0323856 A1 12/2010 Svenberg
2011/0143894 A1 6/2011 Castel
2012/0142503 A1 * 6/2012 Sevadjian ..... A63B 23/1254 482/99
2013/0035220 A1 2/2013 Adams
2013/0190148 A1 7/2013 Allison
2014/0031182 A1 * 1/2014 Donofrio ..... A63B 21/0552 482/129
2014/0069475 A1 3/2014 Enhart
2014/0141948 A1 5/2014 Aronson et al.
2015/0133276 A1 5/2015 Kaye et al.
2016/0074691 A1 3/2016 Pearce
2016/0193490 A1 7/2016 Chen
2017/0144009 A1 5/2017 Pearce
2018/0021616 A1 1/2018 Orady et al.
2020/0289866 A1 * 9/2020 Gvoich ..... A63B 21/4043

FOREIGN PATENT DOCUMENTS

CN 201768299 U 3/2011
CN 203075534 U 7/2013
CN 203763761 U 8/2014
CN 106218788 A 12/2016
DE 102004013737 10/2005
DE 102004013737 A1 10/2005
FR 541324 A 7/1922
FR 2629071 A1 9/1989
WO 8602009 4/1986

(56) References Cited

FOREIGN PATENT DOCUMENTS

| | | | |
|---|---|---|---|
| WO | 8602009 | A1 | 4/1986 |
| WO | 198602009 | A1 | 4/1986 |

OTHER PUBLICATIONS

Extended European Search Report, EP21166064.2, dated Aug. 24, 2021.
European Search Report and Written Opinion dated Oct. 21, 2019 for European Patent Application No. 17762372.5.
Written Opinion dated Aug. 13, 2019 for Singapore Patent Application No. 11201807424V.
https://www.tonal.com/.
International Search Report and the Written Opinion dated Nov. 2, 2017.
US0679784, M. B. Ryan, Aug. 6, 1901.
Supplementary European Search Report, EP17840668, dated Feb. 27, 2020.

* cited by examiner

RESISTANCE-BASED EXERCISE APPARATUS

CROSS-REFERENCE TO RELATED APPLICATIONS

This application is a continuation of application Ser. No. 16/082,316, which is a national phase entry under 35 USC 371 of international patent application PCT/CA2017/050300 filed Mar. 6, 2017, which claims priority to U.S. provisional patent application No. 62/304,528 filed on Mar. 7, 2016, the entire contents of all of which are hereby incorporated by reference.

TECHNICAL FIELD

The application relates generally to exercise machines.

BACKGROUND OF THE ART

Various devices exist for performing resistance or load-bearing exercises. Some of these devices may be used in a non-gym facility, such as in the home or in a hotel room.

Conventional weight-bearing devices or home gyms are often heavy and cumbersome. Many small apartments or homes, campers, hotel rooms, etc. cannot support these structures. Size, space and weight constraints inhibit the use and the availability of these "home" devices.

It is known to provide devices that can be packed up and moved from room to room, or from place to place. Some of these conventional devices are difficult to install or assemble, do not permit changes in orientation, and are too heavy or too large to easily transport, which discourages their use.

Furthermore, effective weight-training requires continuously increasing the resistance or load. Many home devices are restricted in the amount of resistance that can be added, which limits their usefulness.

SUMMARY

In one aspect, there is provided an exercise apparatus, comprising: an elongated support element extending between a first end and a second end, the support element having a mounting member located at each of the first and second ends, each mounting member being engageable with a door or wall surface and mountable thereto to mount the support element thereto; and a resistance-generating assembly, comprising: a stationary member fixedly attached to the support element; a displaceable member mountable to the support element and displaceable therealong relative to the stationary member; at least one resilient member being removably mountable to the stationary and displaceable members and extending therebetween, the at least one resilient member generating resistance upon being elastically deformed by displacement of the displaceable member relative to the stationary member; and a plurality of pulleys, at least one of the pulleys being mounted to the displaceable member and displaceable therewith, at least another one of the pulleys being mounted to the support element, a hand-operable cable engaging the pulleys and being operable to effect displacement of the displaceable member relative to the stationary member.

In another aspect, there is provided a method for mounting an exercise apparatus to a door or wall surface, the method comprising: mounting an elongated support element to the door or wall surface; linking a member being displaceable along the support element to a fixed component of the support element with at least one resilient member, the at least one resilient member generating resistance upon being elastically deformed by displacement of the member relative to the fixed component; and linking the member and the support element with a hand-operable cable, the cable being operable to effect displacement of the member relative to the fixed component.

DESCRIPTION OF THE DRAWINGS

Reference is now made to the accompanying figures in which.

DETAILED DESCRIPTION

Figure 1A:
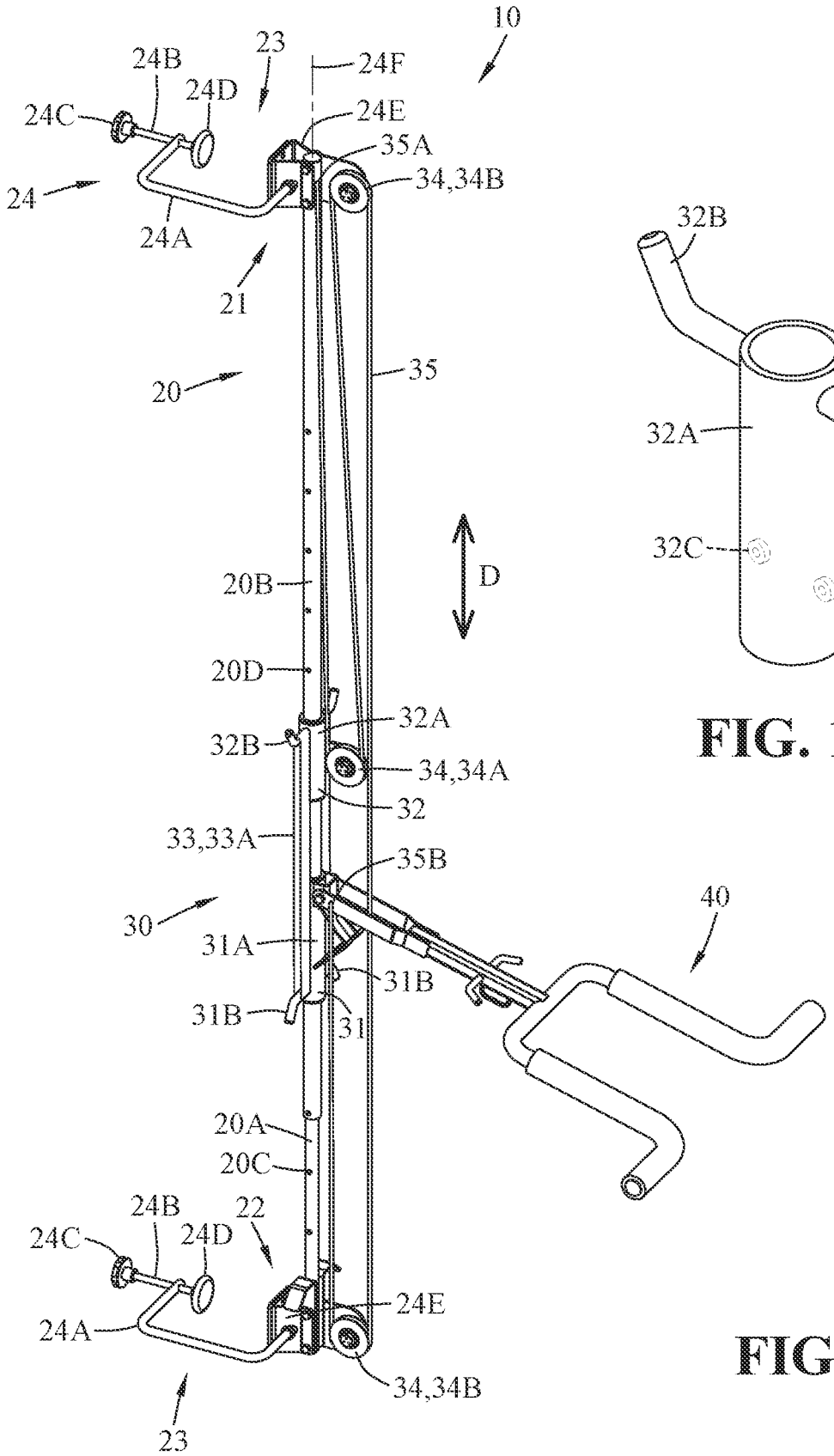
FIG. 1A is a perspective view of an exercise apparatus, according to an embodiment of the present disclosure.

FIG. 1A illustrates an exercise apparatus 10. The exercise apparatus 10 can be used by one or more individuals for resistance exercises as part of a cardiovascular or weight-training regimen. As will be explained below, embodiments of the exercise apparatus 10 allow for it to be disassembled and stored for easy transportation. The exercise apparatus 10 can also be mounted to, and removed from, a support surface such as a door or wall. The exercise apparatus 10 (or simply "apparatus 10") can thus be used as a self-contained exercise machine that can be quickly assembled and installed in any suitable room, such spaces being commonly referred to as "home gyms".

The apparatus 10 includes a support element 20 which can be mounted to a suitable supporting surface, and a resistance-generating assembly 30 which cooperates with the support element 20 to provide the desired resistance for the training exercises.

The support element 20 is the corpus of the apparatus 10 and provides structure thereto. The support element 20 is mounted to, and removed from, a support surface such as a door, a door jamb, door arch, wall, or any part thereof, thereby enabling the apparatus 10 to be mounted to the support surface as well. In the illustrated embodiment, the support element 20 is vertically oriented. In an alternate embodiment, the support element 20, and thus the apparatus 10, are horizontally oriented. In yet another alternate embodiment, the support element 20, and thus the apparatus 10, are oriented at an angle to a horizontal plane.

The support element 20 also provides the requisite load-bearing capacity to the apparatus 10, and allows the apparatus 10 to resist the loads and forces generated when the apparatus 10 is being used. In order to minimise its weight, the support element 20 in the depicted embodiment is at least partially hollow along its length, although other configurations of the support element 20 are also possible. Although shown and described herein as having a cylindrical cross-sectional shape, and being an enclosed structure having a hollow interior, the support element 20 can have other cross-sectional shapes as well. Therefore, reference to a "support tube 20" herein does not limit the support element 20 to being a walled tubular structure. For example, in an alternate embodiment, the support element 20 is a rail. In another alternate embodiment described below, the support element 20 has a non-circular cross-sectional shape.

Still referring to FIG. 1A, the support tube 20 is an elongated object having a longitudinal axis which extends between a first end 21 and an opposed second end 22. The first and second ends 21,22 are opposed extremities of the support tube 20 when the support tube 20 is installed against the support surface. In the embodiment of FIG. 1A, the support tube 20 is telescopic in that it has parts that can be slid relative to one another to lengthen or shorten the support tube 20. More particularly, the support tube 20 includes one or more inner tubes 20A and an outer tube 20B. The one or more inner tubes 20A are slidingly displaceable within the outer tube 20B to lengthen and shorten a length of the support tube 20. A metal bushing can be connected to an inner surface of the outer tube 20B and engage the inner tubes 20A to facilitate their relative displacement. The position of the inner tube 20A relative to the outer tube 20B is fixable at a desired length. In the depicted embodiment, the inner tube 20A has a biaseable prong 20C that is insertable within slots 20D spaced apart along the longitudinal axis of the support tube 20. Other mechanisms for slidingly displacing the inner tube 20A within the outer tube 20B are also within the scope of the present disclosure. This allows a user to select a length of the support tube 20, and to adapt the support tube 20 to the length of a door, for example. The inner and outer tubes 20A,20B allow the support tube 20 to be collapsible, such as when the inner and outer tubes 20A,20B occupy the same length. In such a collapsed configuration, the first and second ends 21,22 are brought closer to one another, and the support tube 20 can be stored away for easy transportation.

Each of the first and second ends 21,22 have a mounting member 23. Each mounting member 23 engages with, and is disengageable from, the support surface. When engaged with the support surface, each mounting member 23 can be attached or secured thereto, thereby allowing the support tube 20 to be mounted to the support surface.

It will therefore be appreciated that the mounting member 23 can be any suitable object capable of such functionality. For example, the mounting member 23 can be a hook, strap, clamp, bracket, or other suitable device which engages the support surface and is attached thereto. When engaged with the support surface, each mounting member 23 is removably attached to the support surface, or fixed thereto. In the embodiment where each mounting member 23 is removably attached to the support surface, the mounting members 23 allow the support tube 20 (and thus the apparatus 10) to be used on different types of support surfaces. In such a configuration, each removable mounting member 23 allows the apparatus 10 to be portable.

In the embodiment of FIG. 1A, each mounting member 23 includes an adjustable clamp 24 for mounting the support tube 20 to a door frame or door jamb, and for removing it therefrom. The clamp 24 has a C-bracket 24A mounted to the first or second end 21,22 of the support tube 20. A distal end of the C-bracket 24A has a hole therein for receiving a rotatable threaded rod 24B through the hole. One end of the rod 24B has a knob 24C, while the other end of the rod 24B has a contact pad 24D. The contact pad 24D may be made of, or coated with, a relative soft material such as rubber to prevent scratching or marking the door frame.

To secure each clamp 24 to the door frame, the user turns the knob 24C. This causes the threaded rod 24B to advance through the hole in the C-bracket 24A towards the proximal end of the C-bracket 24A until the contact pad 24D engages the door frame. The user continues to tighten the knob 24C until a strong friction fit is formed between the contact pad 24D and the surface of the door frame. Once each clamp 24 is attached in this manner to the door frame, the apparatus 10 can be used. The clamps 24 are removed from the door frame in a similar fashion, thereby allowing the apparatus 10 to be dismounted from the door frame. Other configurations for the mounting member 23 are possible and within the scope of the present disclosure.

In the depicted embodiment, each mounting member 23 is pivotably mounted to the support tube 20. This allows the user to select a desired orientation of the support tube 20 while the apparatus 10 is in use to perform the training exercises. This also allows the support tube 20 to pivot or swivel, thereby adjusting its orientation, in response to the training exercises being performed by the user and the forces being applied to the support tube 20. Such pivoting functionality therefore allows the user to overcome space and mounting constraints associated with the specific location of the apparatus 10. This pivoting functionality can be achieved in many different ways.

For example, and as shown in FIG. 1A, the C-bracket 24A of each clamp 24 is connected to a pivot bracket 24E. The pivot bracket 24E is pivotably connected to each of the first and second ends 21,22 of the support tube 20 to allow relative pivotable movement between the pivot brackets 24E and the support tube 20 about a pivot axis 24F for each bracket 24E. The pivot axes 24F are typically aligned with one another and are parallel to the longitudinal axis of the support tube 20.

Still referring to FIG. 1A, the resistance-generated assembly 30 (or simply "assembly 30") allows the user to increase and decrease the resistance as needed. As will be explained in greater detail below, scaling the resistance up or down can be easily performed, and does not require the use of relatively heavy free weights to do so.

The assembly 30 includes a stationary member 31 that is fixed to the support tube 20. The stationary member 31 is a fixed component, and is not displaceable relative to the support tube 20. It can therefore take any suitable form. In the embodiment of FIG. 1A, the stationary member 31 includes a hollow outer tubing 31A which can mounted about the outer surface of the support tube 20 between the first and second ends 21,22. The position of the outer tubing 31A along the outer surface of the support tube 20 is adjustable so that the user can position it anywhere on the support tube 20 and fix its position relative thereto. The outer tubing 31A has one or more hooks 31B for receiving resistance elements, which are described in greater detail below. Other configurations for the stationary member 31 are possible. For example, in an alternate embodiment, the stationary member 31 is a protrusion or extension from the outer surface of the support tube 20 which is capable of receiving the resistance elements, and which is integral with the support tube 20.

The assembly 30 also includes a displaceable member 32. The displaceable member 32 is mounted to the support tube 20 to be slidingly displaceable therealong. More particularly, and as shown, the displaceable member 32 is slidingly displaceable along the support tube 20 in the direction D. As will be explained in greater detail below, the user causes the displacement of the displaceable member 32 by performing the training exercises. The displaceable member 32 is displaceable relative to the stationary member 31 (i.e. towards and away from the stationary member 31), which allows the resistance elements to generate resistance.

Figure 1B:
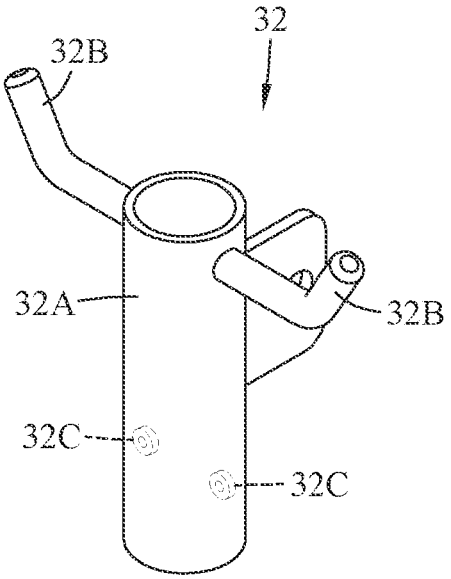
FIG. 1B is a perspective view of a displaceable member of the exercise apparatus of FIG. 1A.

In the embodiment of FIGS. 1A and 1B, the displaceable member 32 includes a hollow and displaceable outer body 32A which is mounted about the outer surface of the support tube 20 between the first and second ends 21,22. The outer body 32A has one or more rotatable members 32C on an inner surface of the outer body 32A which engage the outer surface of the support tube 20 to displace the outer body 32A therealong. In the depicted embodiment, the rotatable members 32C are bearings, but other configurations for the rotatable members 32C are within the scope of the present disclosure. The position of the outer body 32A along the outer surface of the support tube 20 various as it slides therealong in response to the training exercises being performed by the user. The outer body 32A has one or more hooks 32B for receiving the resistance elements. Other configurations for the displaceable member 32 are possible and within the scope of the present disclosure.

The assembly 30 also includes one or more resistance-generating elements. Each resistance-generating element is a resilient member 33 which generates resistance in response to being elastically deformed. In the embodiment shown in FIG. 1A, the resilient member 33 includes one or more resilient bands 33A. Each resilient band 33A is an elastic member which undergoes elastic deformation. The resistance of each resilient band 33A to deformation is what generates the resistance required for the training exercises. Each resilient band 33A can be made from any suitable polymer material which undergoes elastic deformation. Each resilient band 33A may generate the same resistant load, or resilient bands 33A generating different resistant loads may be used. In an embodiment, the resilient bands 33A have visual indicia, are coded or otherwise marked to denote their different resistance values. For example, the resilient bands 33A may be colour-coded, where a given colour is indicative of a specific resistance value. In an alternate embodiment, one or more of the resilient members 33 includes a spring.

Each resilient band 33A extends between, and is removably mountable to, the stationary and displaceable members 31,32. Stated differently, each resilient band 33A links the stationary and displaceable members 31,32 together. In the depicted embodiment, the resilient band 33A is mounted at one of its ends around the hook 32B of the displaceable member 32, and is mounted at the other one of its ends around the hook 31B of the stationary member 31. Referring to FIGS. 1A and 1B, each of the hooks 32B of the displaceable member 32 extend on first and second lateral sides of the displaceable member 32. Referring to FIGS. 1A and 1B, each of the hooks 31B of the stationary member 31 extend on first and second lateral sides of the stationary member 31. Referring to FIGS. 1A and 1B, each of the resilient bands 33A extends between the first lateral sides of the stationary and displaceable members 31,32 and/or between the second lateral sides of the stationary and displaceable members 31,32. When the displaceable member 32 is caused to displace in direction D along the support tube 20 by the user away from the stationary member 31, the distance between the displaceable member 32 and the stationary member 31 increases. This causes each of the resilient bands 33A linking the stationary and displaceable members 31,32 together to stretch, thereby generating resistance.

It can thus be appreciated that the resilient bands 33A allow the user to easily modify the resistance desired for training. For example, if the user wants to experience more resistance, such as for weight training, she may simply add more resilient bands 33A about the hooks 31B,32B of the stationary and displacement members 31,32. Similarly, if the user wants to experience less resistance, such as for cardiovascular training, she may simply remove one or more of the resilient bands 33A, or change the resilient band 33A for one offering less resistance.

This compares favourably to certain prior art exercise machines, which require that free weights be added to a sliding mount. Such a technique for modifying the resistance is cumbersome because it requires manipulating relatively heavy free weights. Furthermore, manipulating relatively heavy weights increases the risk that a weight might be dropped and cause injury, or impact someone while it is being displaced. There is also a limit to how much additional weight the machine can support before experiencing structural stress and/or failure. Furthermore, such a technique for modifying the resistance requires that the user have different free weights available during training. Always having a suitable amount of free weights available for training is cumbersome, expensive, unlikely to occur, and reduces the portability of the machine.

In contrast, the resilient bands 33A disclosed herein weigh little in comparison to free weights, are easy to store, and are easy to transport in large quantities. Therefore, the resilient bands 33A, when used in conjunction with the stationary and displaceable members 31,32, allow the resistance of the apparatus 10 to be rapidly scaled up or down, without the above-described inconveniences and potential dangers associated with free weights.

Still referring to FIG. 1A, the assembly 30 also includes a cable and pulley system to operate the apparatus 10 by displacing the displaceable member 32 to generate the desired resistance, and to allow force to be exerted on the assembly 30. More particularly, the assembly 30 includes multiple pulleys 34 and a hand-operable cable 35. One or more of the pulleys 34A is positioned on the displaceable member 32 and is displaced with the displaceable member 32. The pulley 34A allows the displaceable member 32 to be displaced when the pulley 34A is moved by the cable 35. One or more of the remaining pulleys 34 are mounted to the support tube 20, and are designated herein with reference number 34B. In the depicted embodiment, the support tube pulleys 34B remain fixed in position relative to the support tube 20 and do not undergo displacement.

The hand-operable cable 35 links the pulleys 34 to the support tube 20, to each other, and to the user via an exercise accessory 40. Referring to FIG. 1A, the hand-operable cable 35 extends between and interconnects the portions or segments which make up the support tube 20. The expression "hand-operable" refers to the cable being pulled and moved by the actions of the user. In the embodiment of FIG. 1A, a first end 35A of the cable 35 is attached to the support tube 20, while a second end 35B of the cable 35 is attached to the exercise accessory 40. Referring to FIG. 1A, the cable 35 is positioned outside the portions or segments which make up the support tube 20. In the depicted embodiment, the cable 35 is a single cable 35. In an alternate embodiment, the cable 35 is made up of two or more cable segments.

The operation of the apparatus 10 is now explained in greater detail with reference to FIGS. 2A and 2B.

Figure 2A:
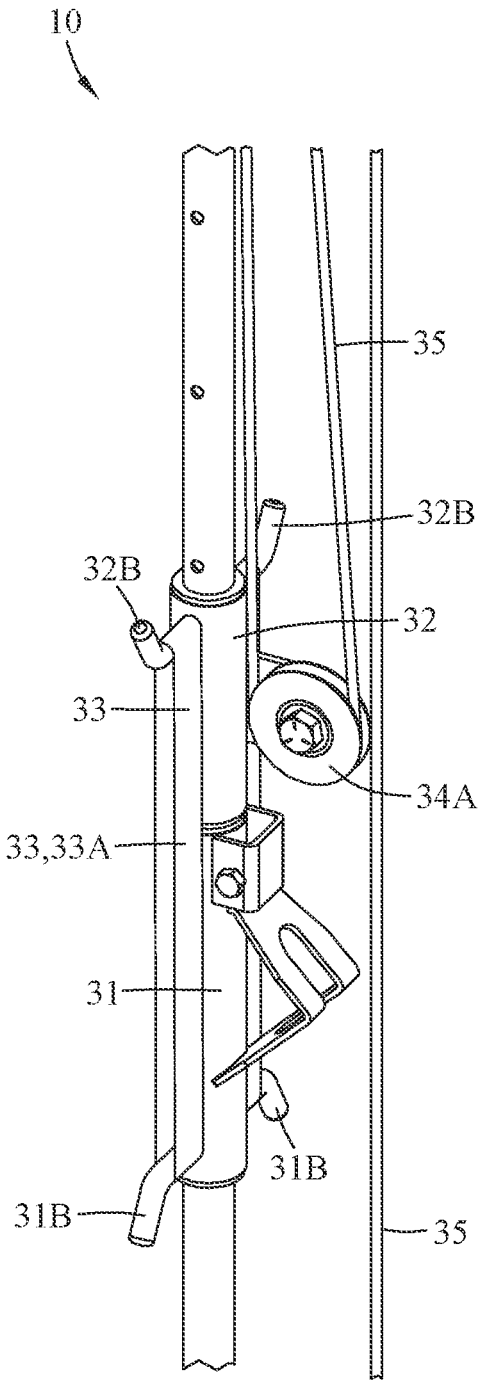
FIG. 2A is a perspective view of the exercise apparatus of FIG. 1A mounted to a wall surface, and showing resilient members extending between a displaceable member and a fixed member.
Figure 2B:
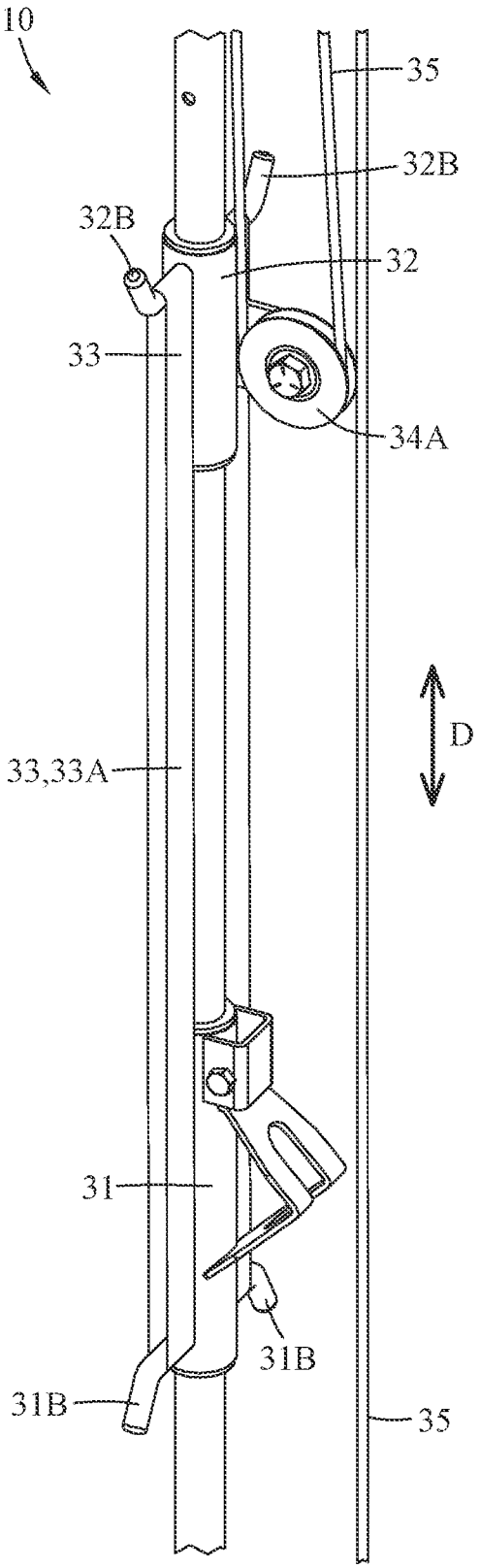
FIG. 2B is a perspective view of the exercise apparatus of FIG. 2A, the displaceable member being shown spaced apart from the fixed member, and the resilient members being shown elastically deformed.

FIG. 2A shows two resilient bands 33A mounted about the hooks 31B,32B of the stationary and displacement members 31,32. The first end 35A of the cable 35 is attached to the support tube 20, while the second end 35B is attached to the exercise accessory 40. The cable 35 extends from its second end 35B and the exercise accessory 40, wraps around a first support tube pulley 34B, is then directed towards a second support tube pulley 34B (see FIG. 2B), wraps around the second support tube pulley 34B, is then directed to the displaceable member pulley 34A, wraps around the displaceable member pulley 34A, and finally ends at the first end 35A at the support tube 20. Other arrangements of the cable and pulley system are also within the scope of the present disclosure. The single cable 35 shown in FIGS. 2A and 2B is easily stored and attached to both the support tube 20 and to the exercise accessory 40, and is easily wound about the components of the apparatus 10.

When no training exercise is being performed, as shown in FIG. 2A, the resilient bands 33A are not elastically deformed, and no resistance is generated. When a training exercise is being performed, as shown in FIG. 2B, the resilient bands 33A are deformed and resistance is generated.

More particularly, in this embodiment, as the user pulls the exercise accessory 40 away from the apparatus 10, she draws on the cable 35. The cable and pulley system causes the displaceable member 32 to displace relative to the stationary member 31 (as shown in FIG. 2B) along direction D. This causes the resilient bands 33A to elastically deform, thereby generating the desired resistance to the pulling of the exercise accessory 40.

Figure 3:
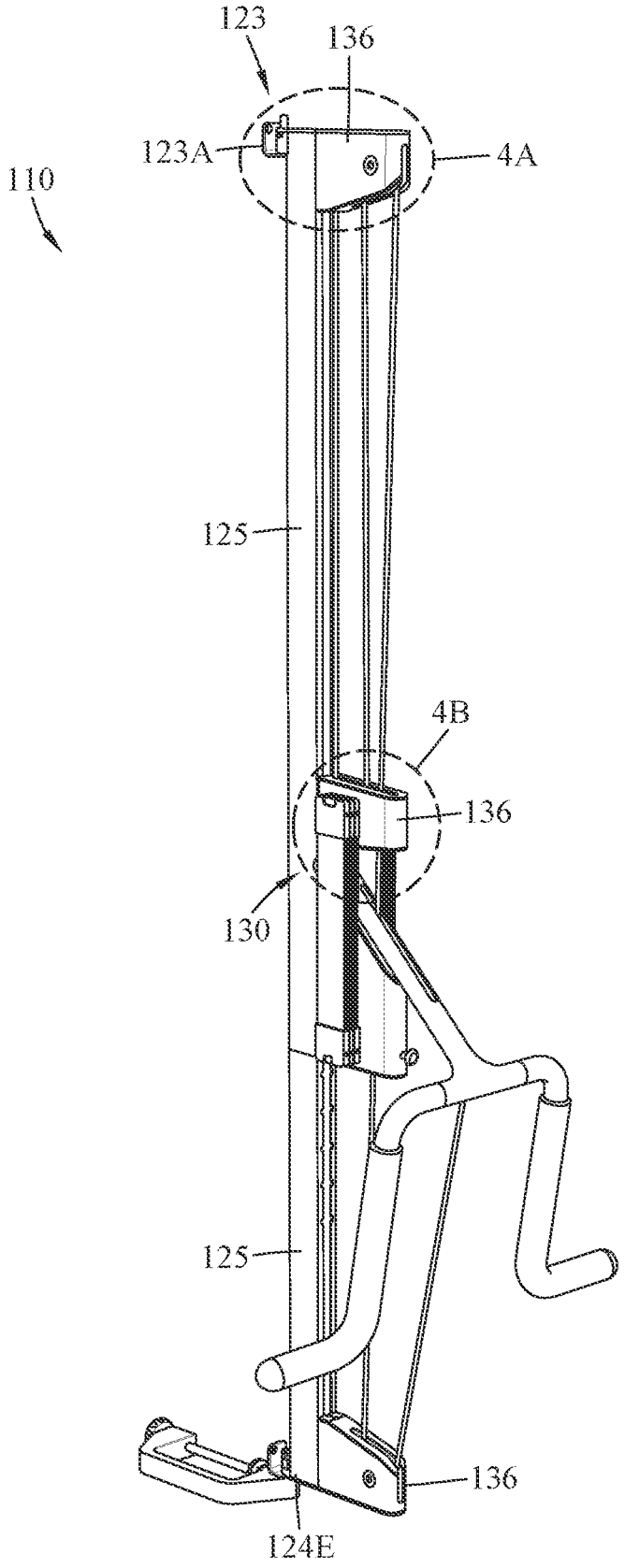
FIG. 3 is a perspective view of an exercise apparatus, according to another embodiment of the present disclosure.

Referring to FIG. 3, an exercise apparatus 110 in accordance with an alternate embodiment is shown, where elements similar to that of the embodiment of FIGS. 1A-2B are identified by the same reference numbers and will not be further described. The resistance-generating assembly 130 of the apparatus 110 includes multiple pulley housings 136 for housing the pulleys 34. Referring to FIG. 3, the resistance-generating assembly 130 of the apparatus 110 includes multiple resistance-generating elements that are stackable such that each of the resistance-generating elements is connectable onto another of the resistance-generating elements. The displaceable member shown in FIG. 3 defines first and second lateral sides, and the stationary member shown in FIG. 3 defines first and second lateral sides. Referring to FIG. 3, each of the resistance-generating elements or one of the stacks of resistance-generating elements extends between the first lateral sides of the stationary and displaceable members, and between the second lateral sides of the stationary and displaceable members 31,32. Each mounting member 123 includes a wall mount 123A and a pivot bracket 124E, and a locking mechanism 150. The support element 120 includes two or more interconnected elongated portions 125. One of the elongated portions 125 defines or forms the first end 21 of the support element 120, and another elongated portion 125 defines or forms the second end 22 of the support element 120. Two or more of the elongated portions 125 having one or more mounting members 23 to mount the elongated portion 125, and thus the interconnected support element 120, to an upright support, for example the door frame, wall or door jamb. These features of the apparatus 110 are now described in greater detail.

Figure 4A:
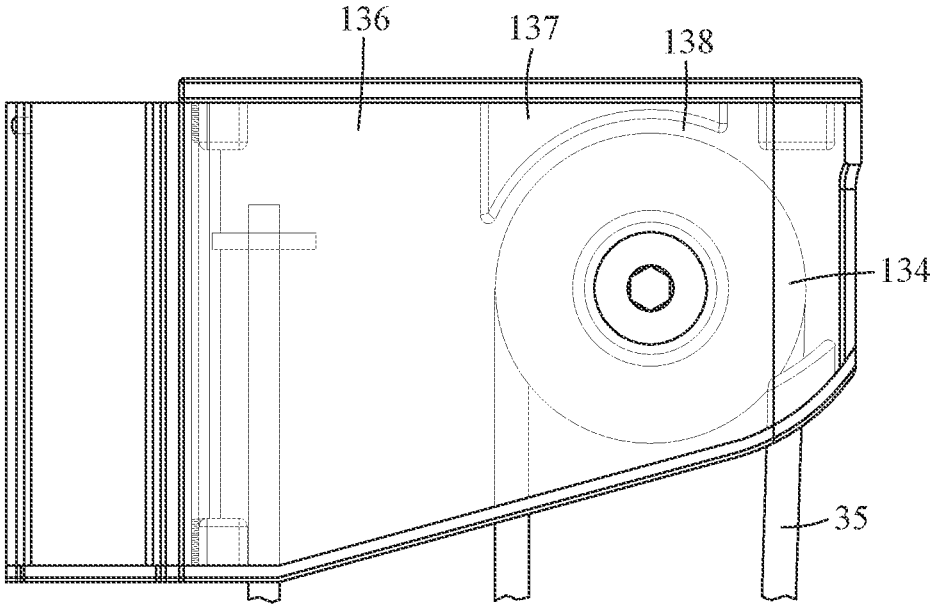
FIG. 4A is a side elevational view of a pulley housing of the exercise apparatus of FIG. 3.
Figure 4B:
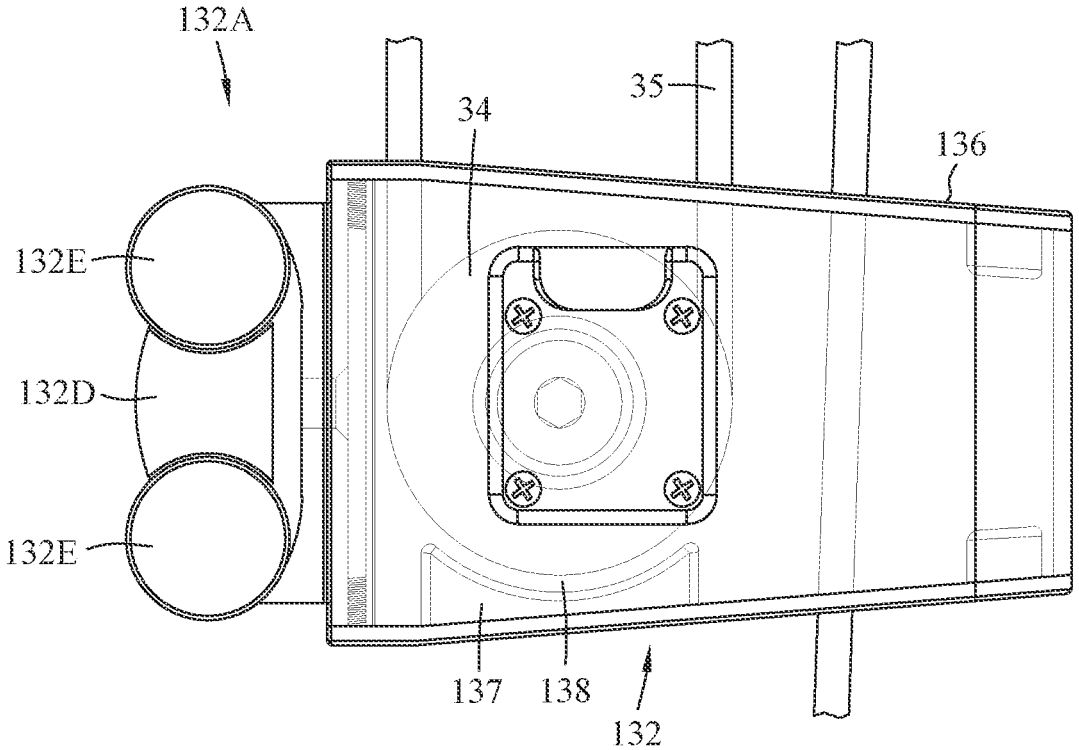
FIG. 4B is a side elevational view of another pulley housing of the exercise apparatus of FIG. 3.

FIGS. 4A and 4B show pulley housings 136 for housing the pulleys 34. The pulley housing 136 shown in FIG. 4A is disposed at the first and/or second ends 21,22 of the support element 120, and is fixed in position. The pulley housing 136 shown in FIG. 4B is part of the displaceable member 132 and is displaceable therewith. Each pulley housing 136 has a cable guide 137 disposed within the pulley housing 136. The cable guide 137 is spaced apart from the pulley 34 to define a gap 138 therebetween. The hand-operable cable 35 is positioned within the gap 138 between the cable guide 137 and the pulley 34. The cable guide 137 is a structure that is secured to the pulley housing 136 to prevent the cable 35 from coming off the pulley 34. Referring to FIG. 4B, the displaceable body 132A of the displaceable member 132 is the pulley housing 136. A displaceable body 132A includes a truck 132D mounted to the pulley housing 136 in fixed relationship therewith. The truck 132D has wheels 132E which engage the support element 120 to displace the displaceable body 132 along the support element 120.

Figure 5A:
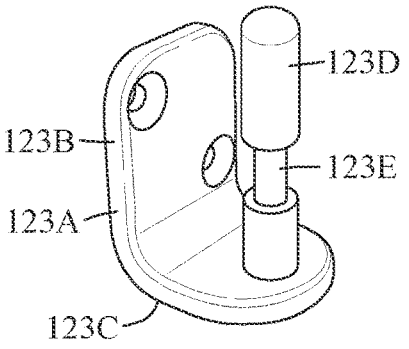
FIG. 5A is a perspective view of a wall mount of the exercise apparatus of FIG. 3.
Figure 5B:
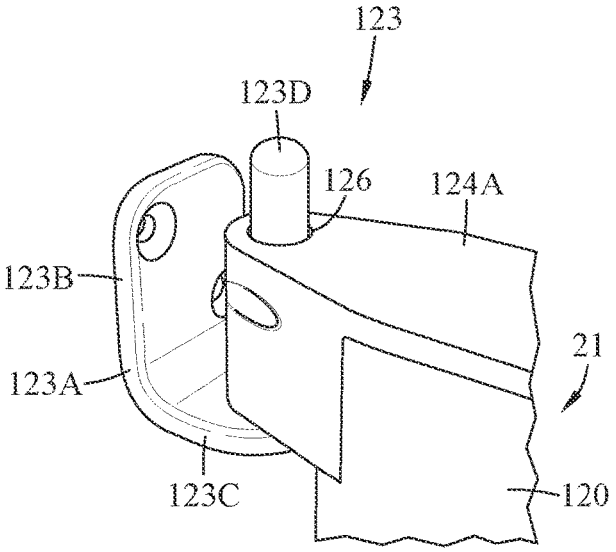
FIG. 5B is a perspective view of the wall mount and a pivot bracket of the exercise apparatus of FIG. 3.

Referring to FIGS. 5A and 5B, at least one of the mounting members 123 includes the pivot bracket 124A having a through hole 126. The pivot bracket 124A is attached to the support element 120 at one of its first or second ends 21,22. The mounting member 123 includes the wall mount 123A which is mountable to the door or wall surface. The wall mount 123A is an L-shaped bracket, and has a first wall 123B interconnected to, an orthogonal with, a second wall 123C. The first wall 123B has apertures therein for receiving fasteners so that the first wall 123B, and thus the wall mount 123A and pivot bracket 124A, can be attached to a wall surface. The second wall 123C has a mounting pin 123D protruding from one or more of the faces of the second wall 123C. In the depicted embodiment, the mounting pin 123D extends from only one face of the second wall 123C. In an alternate embodiment, a mounting pin 123D or separate mounting pins 123D extend from both faces of the second wall 123C in opposite directions. The mounting pin 123D is insertable into the through hole 126 of the pivot bracket 124A, as shown in FIG. 5B. Inserting the mounting pin 123D through the through hole 126 pivotably mounts the support element 120 to the wall mount 123A.

Figure 6A:
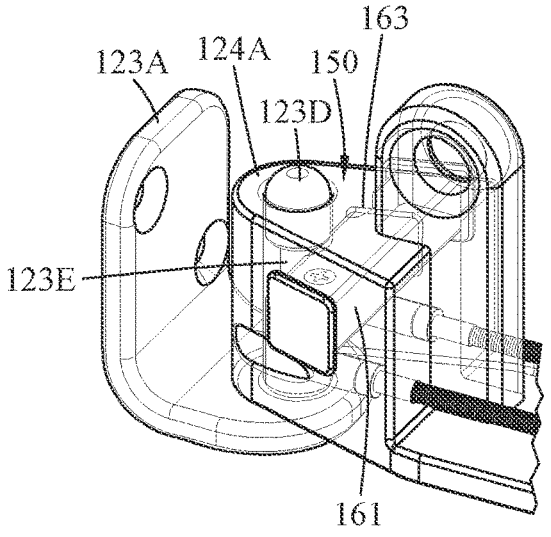
FIG. 6A is a perspective view of a locking mechanism of the exercise apparatus of FIG. 3 shown in a locked position.
Figure 6B:
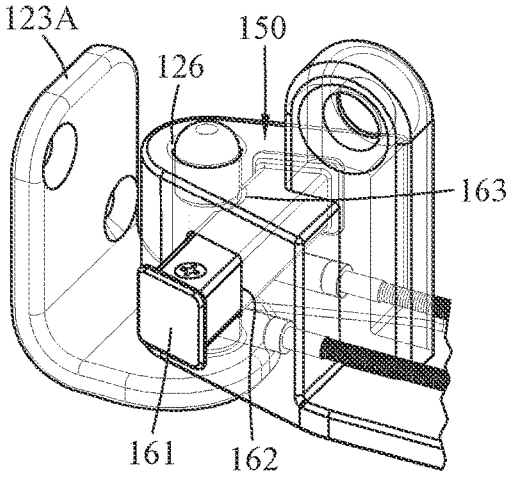
FIG. 6B is a perspective view of the locking mechanism of FIG. 6A shown in an unlocked position.

In an embodiment, the mounting member 123 has a locking mechanism 150 to prevent the support element 120 from becoming removed involuntarily from the wall mount 123A. Many different configurations of a locking mechanism 150 which achieves such functionality are possible and within the scope of the present disclosure. In the embodiment depicted in FIGS. 6A and 6B, the locking mechanism 150 includes a push member 161 insertable through an aperture 162 in the pivot bracket 124A. The mounting pin 123D has a thinned segment 123E with a smaller radius than the remainder of the mounting pin 123D. The push member 161 has a grooved section 163 along a segment thereof. In the locked position, as shown in FIG. 6A, the mounting pin 123D is prevented from being removed from the through hole 126 of the pivot bracket 124A. To enter the locked position, the user pushes the push member 161 into the aperture 162 of the pivot bracket 124A. This displaces the grooved section 163 of the push member 161 such that it is not aligned with the thinned segment 123E of the mounting pin 123D. In the unlocked position, as shown in FIG. 6B, the mounting pin 123D is removable from the through hole 126 of the pivot bracket 124A. To enter the unlocked position, the user withdraws the push member 161 at least partially from the aperture 162 of the pivot bracket 124A. This displaces the grooved section 163 of the push member 161 such that it becomes aligned with the thinned segment 123E of the mounting pin 123D.

Figure 7:
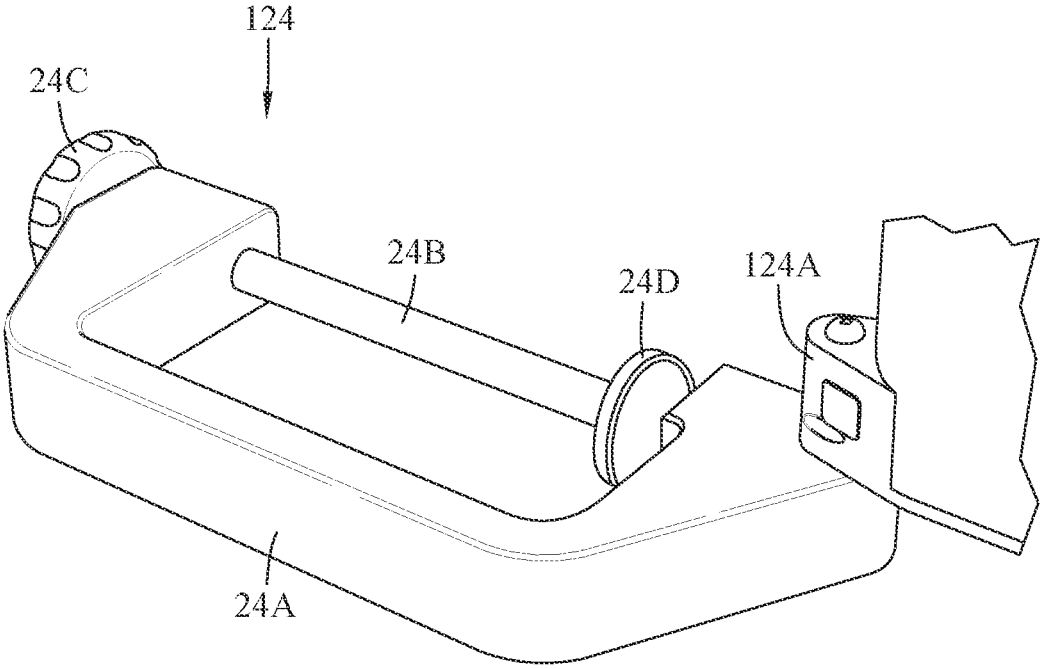
FIG. 7 is a perspective view of a clamp of the exercise apparatus of FIG. 3.

Referring to FIG. 7, another embodiment of the clamp 124 previously described is illustrated. In the depicted embodiment, the clamp 124 is mounted to the pivot bracket 124A. In an alternate embodiment, the clamp 124 is mounted to the wall mount 123A. In such an embodiment, the clamp 124 has an aperture therein for engaging the mounting pin 123D of the wall mount 123A.

Figure 8A:
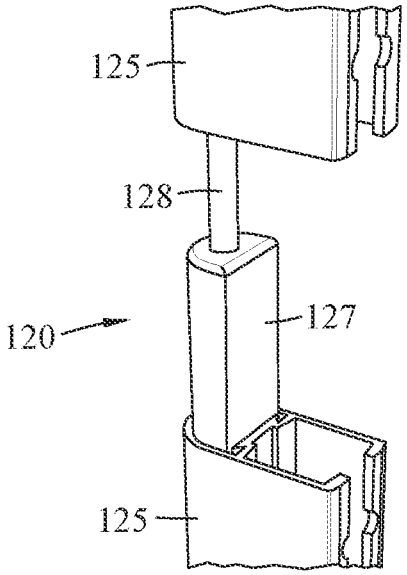
FIG. 8A is a perspective view of elongated portions of the exercise apparatus of FIG. 3 being shown disassembled.
Figure 8B:
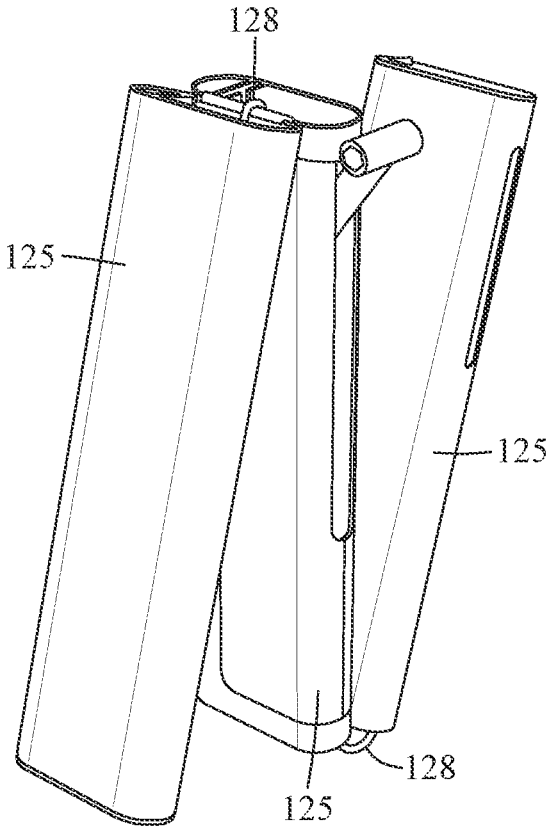
FIG. 8B is a perspective view of the disassembled elongated portions of FIG. 8A.
Figure 8C:
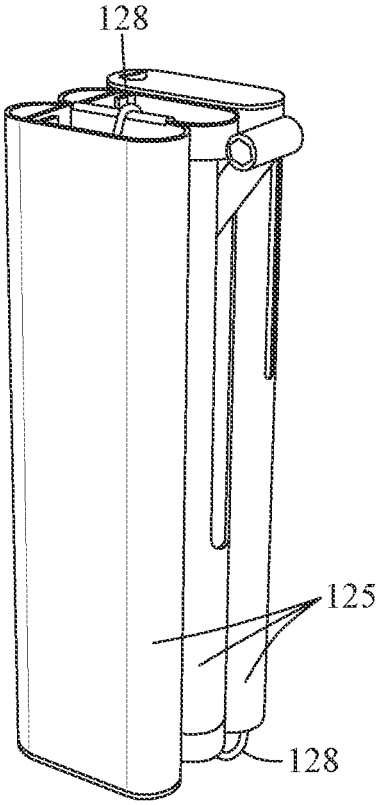
FIG. 8C is a perspective view of the disassembled elongated portions of FIG. 8A stacked side-by-side.

Referring to FIG. 8A, the interconnected elongated portions 125 of the support element 120 are removably mounted to each other to allow the user to quickly assemble and disassemble the apparatus 110. Many different configurations of the elongated portions 125 which achieve such functionality are possible and within the scope of the present disclosure. In the embodiment depicted in FIG. 8A, one of the elongated portions 125 has a sleeve 127 which is friction fitted within a corresponding aperture in an adjacent elongated portion 125. A resilient support cable 128 extends between all the elongated portions 125 and links them together. Referring to FIGS. 8A to 8C, the cable 128 extends through an interior of the elongated portions 125. In an embodiment, the resilient support cable 128 is the same as the hand-operable cable 35. When a user wishes to disassemble the support element 120 for storage or transport, she simply separates each elongated portion 125 from an adjacent elongated portion 125. Since the elongated portions 125 are linked together by the resilient support cable 128, the support portions 125 can be positioned, stacked, folded, or otherwise arranged with respect to each other to facilitate storage and/or transport. For example, and as shown in FIGS. 8A and 8B, the elongated portions 125, linked by the support cable 128, are placed side-by side to minimize the space that they occupy. Referring to FIG. 8C, the longitudinal axes defined by each of the elongated portions 125 are parallel to each other when the elongated portions 125 are placed side-by-side. The support cable 128 reduces the likelihood that the elongated portions 125 will become separated or misplaced.

Referring to FIG. 1A, there is also disclosed a method for mounting the exercise apparatus 10 to a door or wall surface. The method includes mounting the elongated support element 20 to the door or wall surface and linking the displaceable member 32 to the fixed, stationary member 31 with at least one resilient member 33. The method also includes linking the displaceable member 32 and the support element 20 with the hand-operable cable 35. The cable 35 is operable to effect displacement of the displaceable member 32 relative to the stationary member 31.

In light of the preceding, it can be appreciated that the apparatus 10,110 disclosed herein, in at least some of its embodiments, is a resistance-based exercise apparatus 10,110 that is easily transportable, easily stored, and easily installed against a door or a wall for use. The apparatus 10,110 can be mounted in a vertical or horizontal orientation, or in any orientation therebetween. The apparatus 10,110 facilitates cardiovascular and/or weight-training exercises by allowing the user to easily increase the resistance of the apparatus by adding the relatively light-weight and easily-stored resilient bands 33A. The swivel capability of the support tube 20 allows for many different types of training exercises to be performed, for various parts of the body.

The resilient bands 33A are both space and weight efficient. They are easy to transport, and thus facilitate the apparatus' 10,110 transportability.

The materials from which the support tube 20 and stationary and displaceable members 31,32 are made can be relatively lightweight. This reduces the overall weight of the apparatus 10,110, and in some instances, it can be made to weigh less than ten pounds.

Although shown herein as having a particular configuration, the exercise accessory 40 can be any suitable accessory 40 which can be linked to the cable 35 and used with the apparatus 10,110. Some non-limitative examples of suitable exercise accessories 40 include a handle bar, a treadmill, a rowing element, and a leg-extension or leg-curl bench. In addition, the exercise accessory 40 can be used at various positions, and at various orientations, relative to the support tube 20, in order to perform any desired training exercise.

Furthermore, although shown and described as being a door or door frame, the support surface against which the support tube 20 is mounted can be any suitable surface for supporting the apparatus 10,110 while it is in use. Non-limiting examples include walls, door jambs, and door frames.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An exercise apparatus, comprising:

two or more elongated portions being interconnectable to form a support element extending between a first end and a second end, one of the elongated portions defining the first end of the support element having a mounting member, and another one of the elongated portions defining the second end of the support element having another mounting member, each mounting member being engageable with an upright support and mountable thereto to mount the support element thereto, the elongated portions being disconnectable from one another after forming the support element; and a resistance-generating assembly comprising one or more resistance-generating elements removably mountable to one or more of the elongated portions on an outer surface thereof, and a hand-operable cable connected to the one or more resistance-generating elements, the hand-operable cable extending through and interconnecting the elongated portions, the one or more resistance-generating elements generating resistance upon the hand-operable cable being displaced.

2. The exercise apparatus of claim 1, wherein the elongated portions are arrangeable to be transported in a bag or suitcase upon being disconnected from one another.

3. The exercise apparatus of claim 1, wherein the elongated portions are arrangeable side-by-side upon being disconnected from one another.

4. The exercise apparatus of claim 1, wherein each of the elongated portions extends along a portion axis, the elongated portions being arrangeable to minimize a space occupied by the elongated portions upon being disconnected from one another, such that the portion axes are substantially parallel.

5. The exercise apparatus of claim 1, wherein the hand-operable cable prevents the elongated portions from separating from one another.

6. The exercise apparatus of claim 1, wherein the hand-operable cable is positioned outside the elongated portions and interconnects the elongated portions.

7. The exercise apparatus of claim 1, wherein at least one of the elongated portions has a sleeve at a first end thereof and an aperture at a second end opposite to the first end, wherein the at least one elongated portion is a first of the elongated portions, the sleeve of the first of the elongated portions being insertable into an aperture of a second of the elongated portions to interconnect the first and second elongated portions.

8. The exercise apparatus of claim 1, wherein the one or more resistance-generating elements includes multiple resistance-generating elements, each of the resistance-generating elements being stackable and connectable onto another of the resistance-generating elements.

9. The exercise apparatus of claim 1, wherein the support element is pivotably mountable to the upright support.

10. The exercise apparatus of claim 1, wherein one or more of the mounting members includes a clamp clampable to the upright support.

11. The exercise apparatus of claim 1, further comprising an exercise accessory, a distal end of the hand-operable cable being mountable to the exercise accessory.

12. The exercise apparatus of claim 1, wherein the hand-operable cable includes a single hand-operable cable.

13. The exercise apparatus of claim 1, wherein the one or more resistance-generating elements includes a resilient member.

14. An exercise apparatus, comprising:

an elongated support element extending between a first end and a second end and defining a front side and a rear side, the support element having a mounting member located at each of the first and second ends, each mounting member being engageable from the rear side with an upright support and mountable thereto to mount the support element thereto; and a resistance-generating assembly, comprising:

a stationary member fixedly attached to the support element from the front side, the stationary member defining a first stationary member lateral side and a second stationary member lateral side opposite the first stationary member lateral side relative to the front side;

a displaceable member mountable to the support element and displaceable therealong relative to the stationary member, the displaceable member defining a first displaceable member lateral side and a second displaceable member lateral side opposite the first displaceable member lateral side relative to the front side;

one or more resistance-generating elements being removably mountable to the stationary and displaceable members, the one or more resistance-generating elements extending between one or both of the first and second lateral sides of the stationary and displaceable members, the one or more resistance-generating elements generating resistance upon the displaceable member displacing relative to the stationary member; and a plurality of pulleys, at least one of the pulleys being mounted to the displaceable member and displaceable therewith, at least another one of the pulleys being mounted to the support element, a hand-operable cable engaging the pulleys and being operable to effect displacement of the displaceable member relative to the stationary member.

15. The exercise apparatus of claim 14, wherein the one or more resistance-generating elements includes multiple resistance-generating elements, at least one of the multiple resistance-generating elements extending between the first lateral sides of the stationary and displaceable members, at least another one of the multiple resistance-generating elements extending between the second lateral sides of the stationary and displaceable members.

16. The exercise apparatus of claim 14, wherein the one or more resistance-generating elements includes multiple resistance-generating element being connectable together to form one or more stacks of resistance-generating elements, one of the one or more stacks of resistance-generating elements extending between the first lateral sides of the stationary and displaceable members, another of the one or more stacks of resistance-generating elements extending between the second lateral sides of the stationary and displaceable members.

* * * * *